US005636993A

United States Patent [19]

Badry

[11] Patent Number: 5,636,993

[45] Date of Patent: Jun. 10, 1997

[54] AIR INDUCTOR DEVICE FOR CONTROLLED FRESH AIR INTAKE IN AN AIR HEATING SYSTEM

[75] Inventor: Vernon C. Badry, Prince George, Canada

[73] Assignee: Polar Refrigeration Sales & Service Ltd., Canada

[21] Appl. No.: 490,569

[22] Filed: Jun. 15, 1995

[51] Int. Cl.[6] ..... F24F 13/04

[52] U.S. Cl. ..... 454/263; 454/236

[58] Field of Search ..... 454/228, 236, 454/261, 263, 269

[56] References Cited

U.S. PATENT DOCUMENTS

| | | | |
|---|---|---|---|
| 2,962,218 | 11/1960 | Dibert | 237/55 |
| 3,387,649 | 6/1968 | Mullins et al. | 454/269 X |
| 4,730,771 | 3/1988 | Shepherd et al. | 236/13 |
| 5,413,530 | 5/1995 | Montaz | 454/263 X |

FOREIGN PATENT DOCUMENTS

| | | | |
|---|---|---|---|
| 685597 | 5/1964 | Canada | 237/50 |
| 2084753 | 5/1991 | Canada . | |
| 511279 | 12/1920 | France | 454/263 |
| 6-272949 | 9/1994 | Japan | 454/261 |
| 43962 | 11/1925 | Norway | 454/263 |

*Primary Examiner*—Harold Joyce

*Attorney, Agent, or Firm*—Hayes, Soloway, Hennessey, Grossman & Hage, P.C.

[57] ABSTRACT

A fresh air inductor device for installation with a forced-air heating appliance ensures an adequate supply of fresh air is tempered prior to introduction to the heating appliance. Air from the supply plenum of the heating appliance is applied to the device together with outside air. The supply plenum air enters the device through a venturi tube, the decreased pressure created draws in outside air, which mixes with the supply plenum air before being introduced to the return plenum of the heating appliance. Various configuration of venturi tube within the air inductor device regulate flow rate and air mixing characteristics.

19 Claims, 8 Drawing Sheets

AIR INDUCTOR DEVICE FOR CONTROLLED FRESH AIR INTAKE IN AN AIR HEATING SYSTEM

FIELD OF THE INVENTION

This invention relates to air inductor devices for controlled fresh air intake in an air heating system.

BACKGROUND OF INVENTION

In recent years residential house construction has been altered to make them more energy efficient and to reduce heating costs. One method used to achieve this has been to seal the structure to reduce the amount of cold outside air infiltrating into the living space. From an energy perspective this is a good approach but from occupancy perspective there are potential problems. People within the house require fresh air to breath, and fresh air also removes toxins and odours that can accumulate within the house. To deal with these conflicting needs for fresh air the National and Provincial Building Codes have established minimum ventilation standards for residential dwells. Typical standards require 0.3 air changes per hour for the dwelling (either year round or only during the heating season).

Inherently, a lot of house air goes up the chimney from the combustion chamber and must be replaced by outside air. In modern houses have become increasingly air tight in order to conserve energy, particularly in colder climates. This has led to a need for ensuring adequate replacement of air in buildings where there is a combustion heating system, such as oil or gas. It is known to provide a duct from the outside emptying into the building basement to provide such make-up air. Typically, an inlet duct is provided to deliver outside air to the vicinity of the combustion chamber for provision of such makeup air. This approach may create some problems for both the building occupants and the heating system. A better idea is to introduce the make-up air into the cold air return duct of the furnace, where it is mixed with air that is going to be heated on the heating coils of the furnace and distributed to the house through the hot air plenum.

Practically all houses and small commercial buildings have a tendency toward a negative internal pressure due to forced exhausting of internal air. This is due mainly to expelling undesirable air from a building by using an exhaust fan blowing out and passively supplying replacement fresh air via a vent.

An improvement over this is to have an outside air duct leading into the cold air return on the furnace, where it mixes with cold air returning from parts of the house, and is then fed to the heat exchanger from which it proceeds to the hot air plenum, providing heated air through the building. For example, as is disclosed by Blotham et al. in Canadian Patent No. 685,597, issued May 5, 1964.

Hence, the idea of introducing outside air into the return air side of the furnace is well known. However, the increased ventilation requirements, resulting from increased air tightness of modern house, has increased the requirement for fresh outside air. For example, Sheperd et al. in U.S. Pat. No. 4,730,771, issued Mar. 15, 1988, disclose a hot air furnace in which hot air from the hot air plenum is fed into the make-up air duct, and then fed into the return air plenum of the furnace. The hot air is used to draw the make-up air. A damper within the make-up air duct at the junction of the hot air supply regulates air flow.

Many proposals introduce a heat exchanger into the chimney flue, for example U.S. Pat. No. 2,962,218 issued to F. Dibert, Nov. 29, 1960. The introduction of heat exchangers into the chimney flue may cause problems. For example, when this fresh air crosses the heat exchanger, under certain circumstances, a rain forest condition may be created in the heat exchange chamber. Additionally, the heat exchanger may not adequately handle an extreme temperature gradient between flue gases and incoming outside air. Further, the flue gases may contain toxic mist. Consequently, the life expectancy of heat exchangers and flues may be very short. It has been determined experimentally that the tempering the air with circulation air improves the temperature gradient across the heat exchanger.

When the outside temperature drops to the range of −22° to −40° F. (−30° to −40° C.), ensuring a regulated supply of the outside air is critical. If there is insufficient air, the combustion in the furnace is incomplete and the supply of fresh air for the occupants becomes seriously limited.

Building codes are beginning to require that any incoming air be warmed to a minimum 55° F.(13° C.) before it is introduced into the premises. Major problems arise from the need to heat up the outside air before it is fed into any plenum. As discussed above, flue gas heat exchangers have been proposed. The use of electrical heating coils for this purpose has been suggested, but clearly this is not the best solution, as it introduces an electrical heating element into the combustion heating system of the house.

Canadian Patent Application 2,084,753 discloses a mixing device wherein fresh air is induced through a nozzle of an adjustable aperture. In one embodiment, the fresh air is mixed with heated air. This arrangement may require too large of a air volume through the nozzle to be practical to provide desired fresh air induction rates.

SUMMARY OF THE INVENTION

It is an object of the present invention to provide an improved apparatus for controlling the fresh air intake in an air heating system.

According to one aspect of the present invention there is provided an air inductor device comprising a chamber having first and second inlets and an outlet, the first inlet and the outlet being substantially aligned along a first axis; and a venturi tube inside the chamber coupled to the first inlet having a reduced diameter exit; the first inlet for connecting a first duct from a supply plenum of a forced air heating appliance to the chamber, the second inlet for connecting a supply of outside air to the chamber, the outlet for connecting the chamber to a return plenum of the forced air heating appliance whereby air from the supply plenum mixes with outside air within the chamber to provide tempered air to the return plenum.

According to another aspect of the present invention there is provided an air heating system having a forced air heating appliance, a supply plenum for carrying heated air, a return plenum for carrying cooled air and a fan between the return plenum and the supply plenum an air inductor device comprising a chamber having first and second inlets and an outlet, the first inlet and the outlet being substantially aligned along a first axis; a venturi tube inside the chamber coupled to the first inlet having a reduced diameter exit; the first inlet for connecting a first duct from the supply plenum of the forced air heating appliance to the chamber, the second inlet for connecting a supply of outside air to the chamber, the outlet for connecting the chamber to the return plenum of the forced air heating appliance whereby air from the supply plenum mixes with outside air within the chamber to provide tempered air to the return plenum.

According to a further aspect of the present invention there is provided an air heating system comprising a forced air heating appliance having a fan for drawing air from a plenum inlet through a heat exchanger and out a plenum outlet; a supply plenum connected to the plenum outlet for supplying air from the heating appliance to a building; a return plenum connected to the plenum inlet for returning air from the building to the heating appliance; an outside air duct for supplying air from outside the building; and an air inductor device comprising a chamber having first and second inlets and an outlet, the first inlet and the outlet being substantially aligned along a first axis; and a venturi tube inside the chamber coupled to the first inlet having a reduced diameter exit; a first duct connecting from the supply plenum of the forced air heating appliance to the first inlet of the chamber; a second duct connecting the outside air duct to the second inlet of the chamber; a third duct connecting the outlet of the chamber to the return plenum of the forced air heating appliance whereby air from the supply plenum mixes with outside air within the chamber to provide tempered air to the return plenum.

The present invention is an attempt to correct this problem and to address the tempering of the incoming air to comply with building ventilation codes, manufacturer's design conditions of their heating appliances, safety engineering branch of government for public safety and economic benefits to the end user.

For example, one building code appears to require than any incoming air must be warmed to a minimum 55° F. before it is introduced into the premises.

The present invention is not concerned with providing an air circuit for modern high efficiency furnaces, which require 0.3 air charge/hour.

The philosophy of the design is to bring potentially cold outside air into the building, mix it with warm inside air, and then distribute it throughout the house. Hence, the building occupants and equipment are not exposed to a cold stream of air from the outside. The mixing and delivering of fresh air is done by incorporating the intake of fresh air into an existing forced air heating system using a unique flow inducer system.

Advantageously, the apparatus of this invention improves the efficiency of the furnace and heat recovery ventilators, and also extends the life expectancy of the heating system.

Another advantage of this invention is that energy conservation is enhanced through efficiency gains obtained by supplying the furnace with air at temperatures substantially greater than the outside temperature.

Another advantage of the present invention is improved efficiency of the exhaust fans.

Advantageously, the apparatus of the present invention substantially reduces the drafts from doors, windows and other outside openings.

Another advantage of the present invention, through its use with new mid efficiency furnaces, whereby it reduces the back drafting of hot water tank atmosphere burner when connected to a common vent with its over combustion blower.

BRIEF DESCRIPTION OF DRAWINGS

The present invention will be further understood from the following description, with reference to the drawing in which.

DESCRIPTION OF THE PREFERRED EMBODIMENTS

Figure 1:
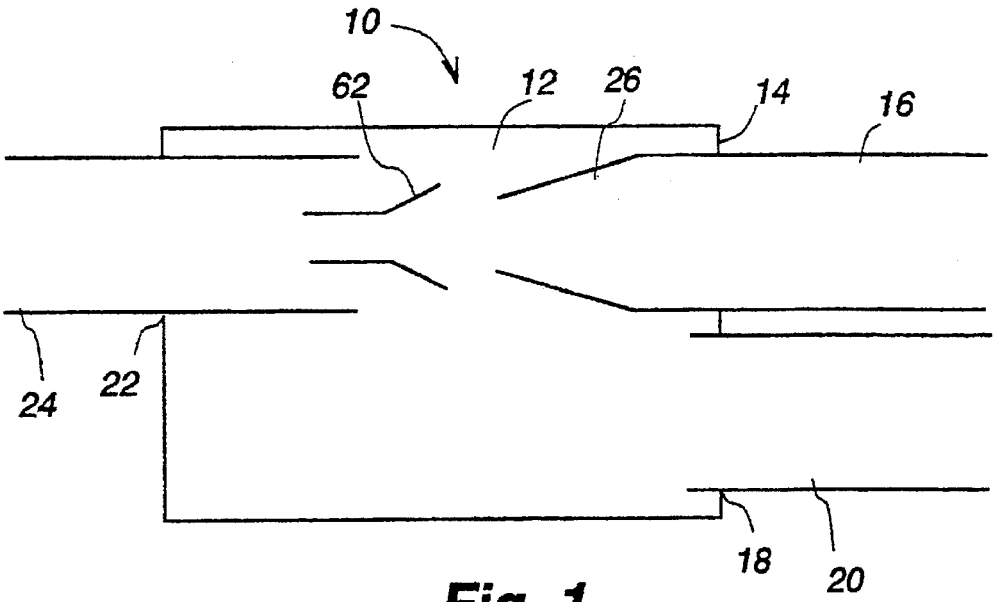
FIG. 1 schematically illustrates in a lateral view of an air inductor device in accordance with an embodiment of the present invention.

Referring to FIG. 1, there is illustrated an air inductor device in accordance with an embodiment of the present invention. The air inductor device 10 includes a chamber 12.

Referring to FIG. 1, there is illustrated an air inducer device in accordance with an embodiment of the present invention. The air inducer device 10 includes a chamber 12, a first inlet 14 for connection to a first air duct 16, a second inlet 18 for connection to a second air duct 20 and an outlet 22 for connection to a third air duct 24. With the chamber 12, a venturi tube 26 is coupled to the first inlet 14 and a funnel 28 is coupled to the outlet 22.

Figure 2:
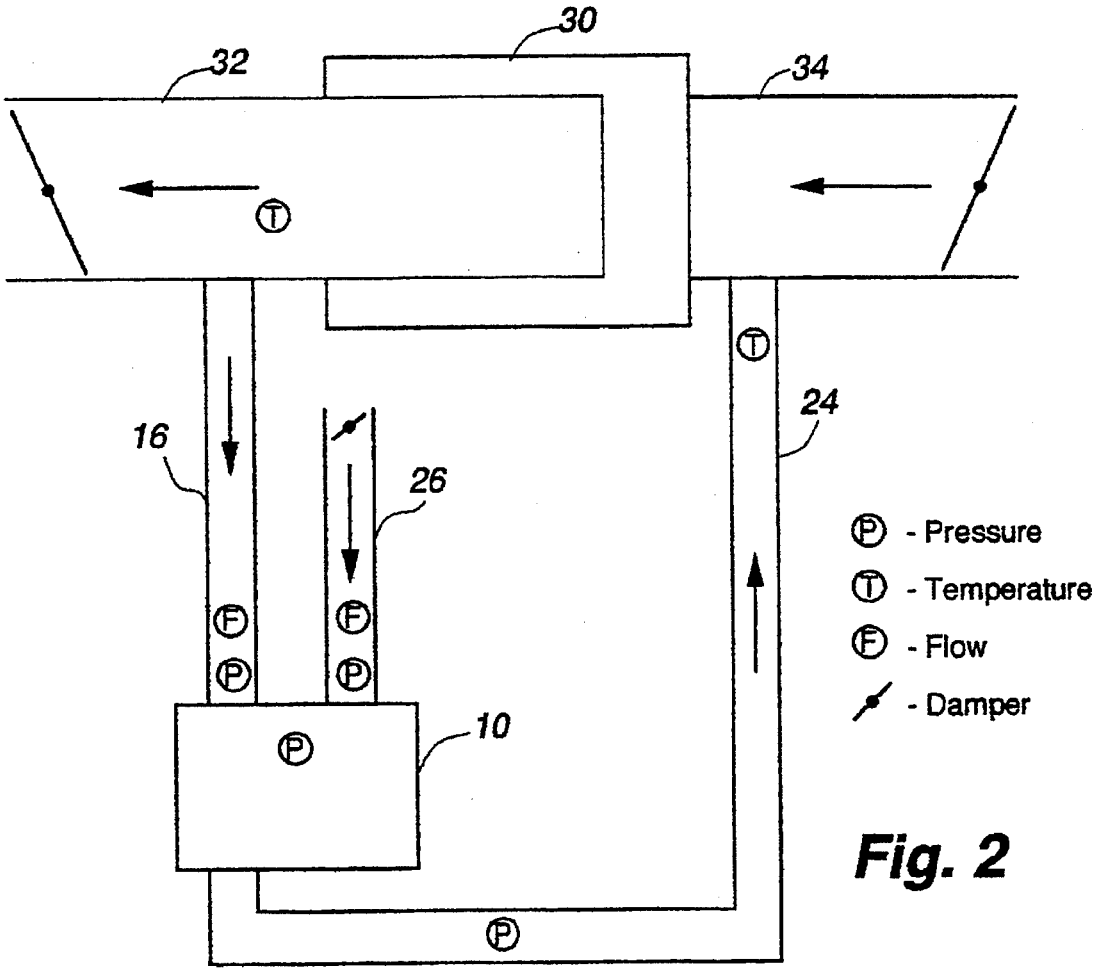
FIG. 2 schematically illustrates the air inductor device of FIG. 1 connected a conventional forced air furnace.

Referring to FIG. 2, there is illustrated the air inducer device of FIG. 1, connected to a conventional forced air furnace. The air inducer device 10 is connected to forced air furnace 30 via the first air duct 16 coupled to a supply plenum 32 and via the second air duct 20 coupled to outside air. For testing the air inducer device 10, pressure, temperature, and flow was monitored at points in the test system indicated by P, T, and F, respectively.

In operation, heated air from the higher pressure supply is applied via the first air duct 16 to the air inducer device 10 via the second air duct 20. The heated air enters the chamber 12 via the venturi tube 26. The decreasing diameter of the venture tube 26 increases the rate of flow of the heated air and causes a corresponding decrease in pressure, phenomenon defined by Bernoulli's principle.

The pressure differential thus generated, draws fresh outside air into the chamber 12 where it mixes with the heated air to exit the chamber 12 via the funnel 22 and the outlet 22 and the third duct 24. The outside air, tempered with the heated air exits the chamber 12 via the outlet 22 and is supplied to the return plenum 34 via the third duct 24.

The operation is based on well known and accepted principles of incompressible fluid dynamics. Some of the supply air from the furnace is diverted through this fresh air inducer unit instead of going out to heat the house. Within the unit the supply air is accelerated by a converging duct (venturi element) that is at the end of the supply air duct. The conservation of volume allows the velocity at any point in the duct to be calculated by $$Q=VA$$

where Q is flow rate, V is velocity and A is cross-sectional area. For round ducts the area is calculated using $$A=0.785\ D^2$$

Where D is the duct diameter. The relatively high velocity supply air flowing out of the venturi is at a reduced pressure, in accordance with Bernoulli's equation that relates velocity to static pressure. If the losses are neglected Bernoulli's equation is $$\rho V_2^2+2p_2=\rho V_1^2+2\rho_1$$

where p is pressure, ρ is density and the subscripts refer to different locations along the duct. Combining these three equations indicates the drop in pressure is related to the fourth power of the diameter ratio of the entry and exit of the venturi. This effect of reducing pressure by increasing flow speed in commonly referred to as the venturi effect. It is this low pressure created by the venturi that is used to create a low pressure in the inducer box and draw fresh air into the heating duct system from the outside. The fresh and supply are mixed within the box, the subsequent ductwork and plenum on the return side of the furnace.

A final element within the fresh air inducer device is a secondary inducer element, in the form of the funnel 28. The purpose of this element, is to enhance the mixing of the fresh and supply air streams without causing a substantial restriction in flow.

Despite the relatively simple principles involved in this device the flows of supply or fresh air passing through it are not readily calculated. The problem is that pressure set by the venturi is not the pressure established in the fresh air inducer box because of the added flow of fresh air. The flow characteristics of the inducer unit must be determined experimentally.

Laboratory based tests have been performed on various embodiments of the present invention of the fresh air inducer unit. The results of these tests show the performance of the unit and its ability to induce fresh air into the ductwork of the furnace. In all experiments the fresh air was actually room laboratory air. Calculations have been used to predict performance down to ambient conditions of −40° C. A method of performing these calculations for any combination of supply and fresh air is also provided.

Test Setup

The fresh-air inducer device 10 was connected, as shown in FIG. 2, to a domestic furnace in a laboratory environment at the University of Alberta, Department of Mechanical Engineering. The furnace used in these tests was a ICG model 4D-60 with an input power rating of 60,000 Btu/h and efficiency of 77%. Ducts and flow dampers were installed to simulate the pressures and flows expected on the supply and return side of the furnace in a typical residential installation. Ducts attached to the inducer were of a length needed to provide a fully developed velocity profile suitable for accurate flow measurement. In all cases the ductwork and inducer box were sealed with duct tape to prevent any leakage.

Diagnostics

The test equipment was instrumented with averaging pitot tubes, static pressure taps and thermocouples. The averaging pitot tubes, indicated by "F" in FIG. 2, were used to measure the flow rate in the supply air to the inducer as well as the amount of fresh air drawn into the system through the operation of the inducer. The pressure differences from the averaging pitot tubes were measured with a Validyne pressure transducer. The averaging pitot tubes were calibrated against a standard ASME orifice meter. Static pressure taps, indicated by "P" in FIG. 2, were used to measure pressures in the supply and return plenums 32 and 34, respectively, as well as pressures in the inducer chamber 12 during operation. Supply and return pressures were adjusted by opening or closing flow dampers on the supply and return side of the furnace, and in the fresh air intake. The static pressures were recorded using oil filled inclined manometers. Thermocouples, indicated by "T" in FIG. 2, were used for temperature measurement within the ducts, plenums and chimney flue in order to follow the energy flows throughout the system.

Methodology

The approach used in all cases was to fix the static pressures in the supply air duct just upstream of the fresh air inducer unit and in the return air duct just downstream of the unit. The values chosen to perform the tests were suggested +/−0.16 in. $H_2O$, and are typical values for domestic heating systems. The parameters varied were the combination of cones that creates the venturi effect in the inducer unit, as well as varying the position of the different secondary inducer elements. For each physical setup the fresh air intake damper was varied through a range of settings to simulate different flow restrictions. The flow restrictions are of interest in the prediction of performance with different combinations of entry (hood type and screen mesh size) and duct work (number of elbows, length of duct). Tests were conducted with unheated flows (burner off) and heated flows after the system had come to steady state operation. At each test condition all the flows and relevant temperatures were recorded.

Experimental Results

The results presented are broken into two main sections. The first section is the measured performance of the inducer unit under both unheated and heated conditions. The second section uses these measured data as a basis for predicting the performance of the unit in conditions that cannot be measured (i.e., fresh air temperatures down to −40° C.).

Measured Performance—Unheated Flows

A series of unheated (burners off) flows were initially tested. These flows are of direct interest to non-heating season or shoulder season (spring or fall), ventilation when the furnace fan is run on manual. The unheated results are also the basis for the predicted performance.

CASE 1: Large 4 inch venturi—3 inches from end of venturi to inlet of return duct, No secondary inducer Referring to FIG. 3, there is schematically illustrated internal configuration of the air inductor device of FIG. 2, for test case 1.

Figure 3:
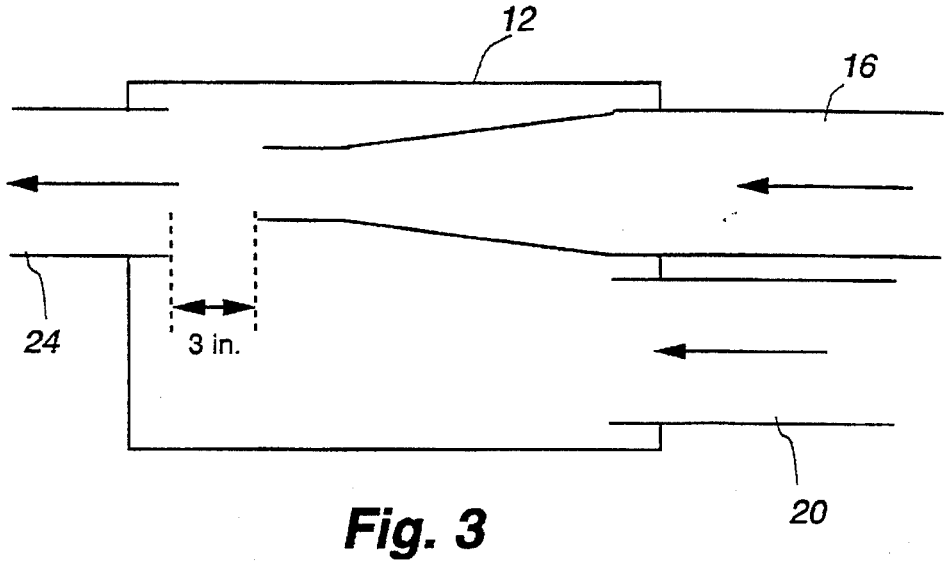
FIG. 3 schematically illustrates internal configuration of the air inductor device of FIG. 2, for test case 1.

This configuration, shown in FIG. 3, was considered the base case to which all other combinations of venturi and inducer were compared.

Figure 4:
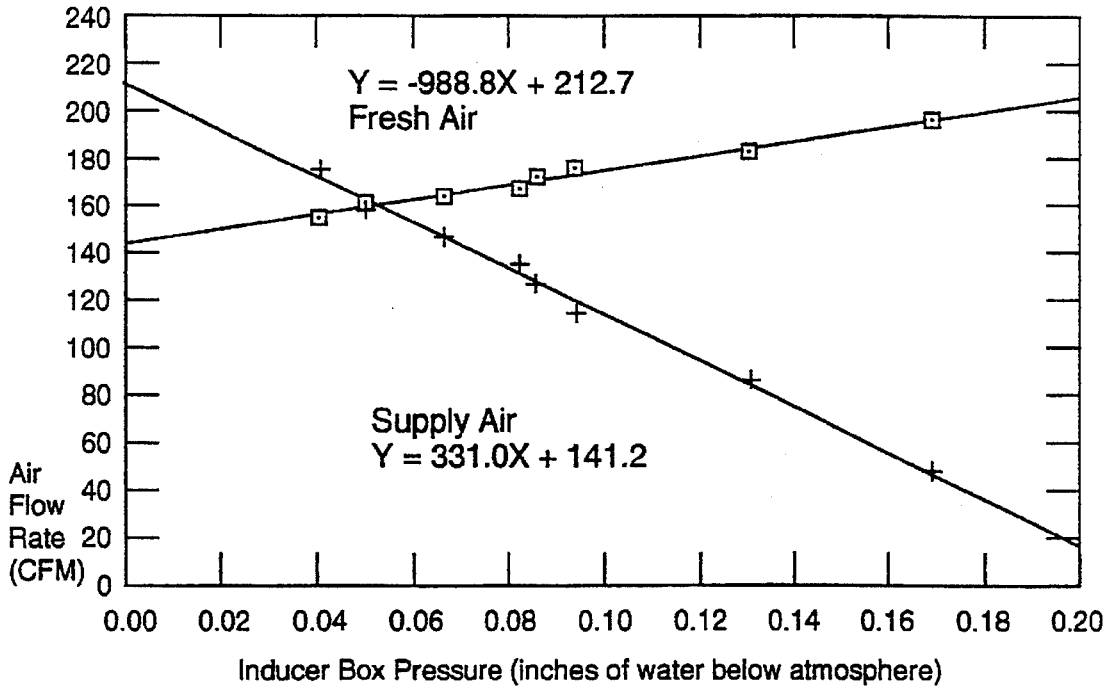
FIG. 4 graphically illustrates the test flow rates for the configuration of FIG. 3.

Referring to FIG. 4, there is graphically illustrated the test flow rates for the configuration of FIG. 3. FIG. 4 shows the flow rates of the supply and fresh air going to the inducer device as the pressure in the fresh air duct (or similarly the inducer box) changes.

Note that in the figures flow rate is plotted against the absolute value of box pressure (in reality the box pressure is slightly below atmospheric). Similarity the equations shown were generated using pressure measured below atmospheric. The data points on the extreme left of the graph are when the fresh air damper is wide open and flow restriction is created by ten feet of eight inch straight duct, as well as entry and exit losses. The data points on the extreme right are when a loosely fitting damper is in the fully closed position and represents a very high flow restriction on the fresh air side. As the fresh air damper is closed the flow of fresh air drops linearly. The supply air flow rate, set as a result of the condition of a constant +0.16 in $H_2O$ pressure at the inlet to the inducer box and −0.16 in $H_2O$ at the outlet of the inducer box, increases linearly. In all the unheated tests the flow rates have been corrected to 21° C. and one atmosphere pressure.

Figure 5:
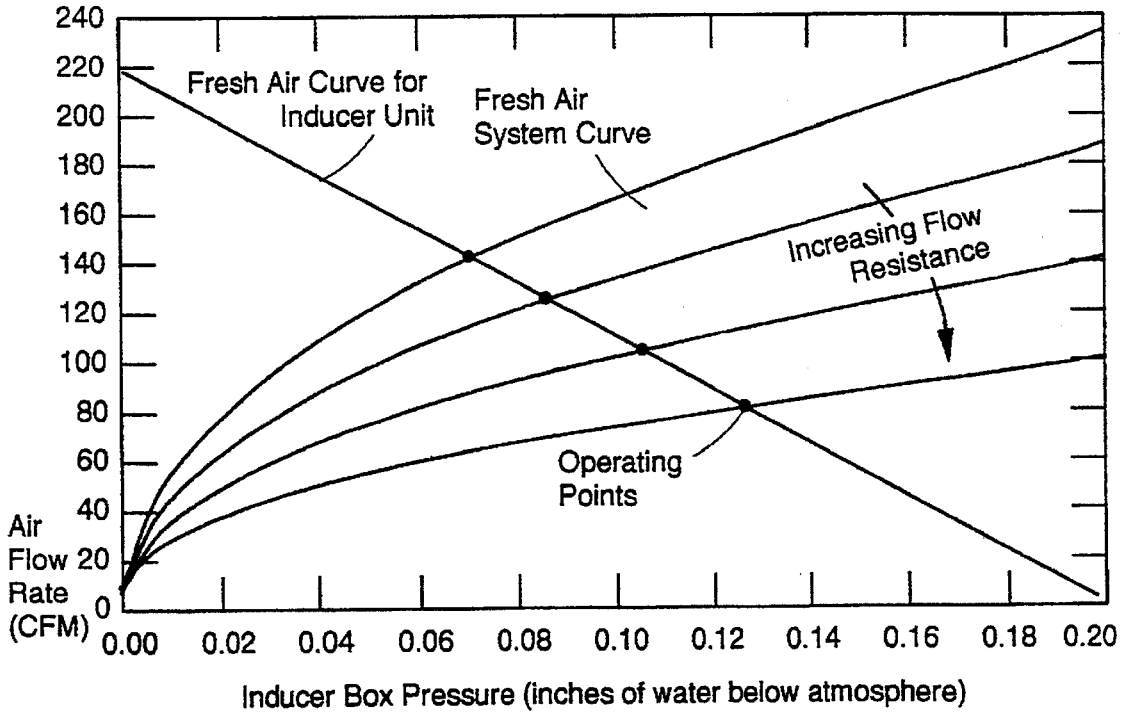
FIG. 5 graphically illustrates operating points of the air inductor with varying system resistance.

A typical installation for the fresh air intake system would be 15 feet of ducting, two 90° elbows and an inlet screen. The pressure drop in the fresh air ducting would fall somewhere in the middle of the extremes plotted in FIG. 4. The pressure drop in the 15 feet of duct, two elbows, screen and entry losses can be calculated as a function of the flow rate in an 8 inch duct. Data for the pressure drop across these different components and friction loss can be found in publications such as the ASHRAE Fundamentals. The operating point is the intersection of this function will the fresh air flow rate curve that has been measured. Referring to FIG. 5 there is graphically illustrated operating points of the air inductor with varying system resistance. A generic form of these curves is shown in FIG. along with the different operating points when the fresh air intake ducting is altered.

When these calculations are performed for the typical installation suggested above, the inducer box would be at −0.065 inches $H_2O$ and the flow rate of fresh air would be approximately 140 cfm. In meeting the National Building Code for 0.3 air changes an hour this scales to a 1750 square foot home (e.g., floor plan of 35×50 feet) with 8 foot high basement and main floor spaces. Alternately, this configuration of could supply the necessary fresh air for a two story house with full basement with a floor plan 30×40 feet.

Figure 6:
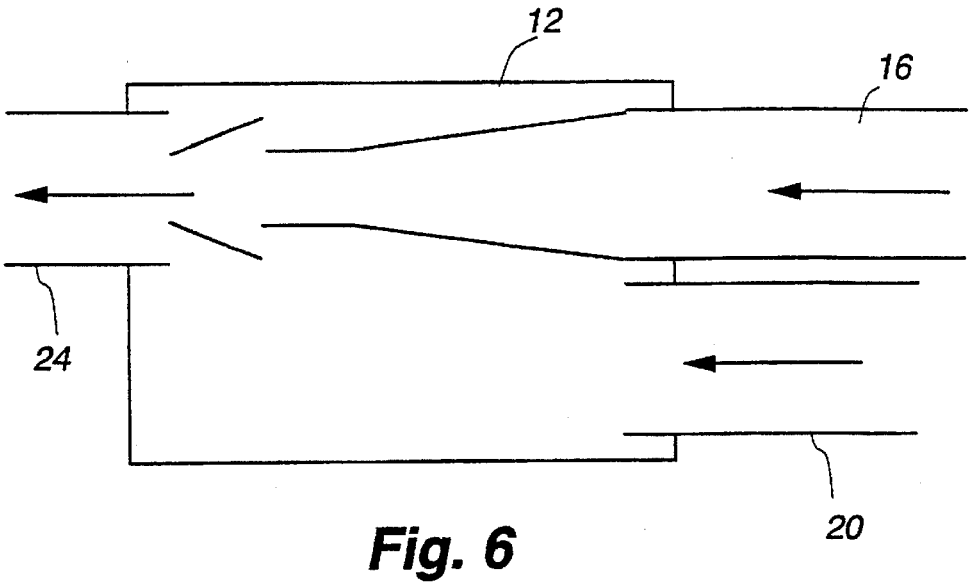
FIG. 6 schematically illustrates internal configuration of the air inductor device of FIG. 2, for test case 2.

CASE 2 Large 4 inch venturi—3 inches from end of venturi to inlet of return duct, Large Secondary Inducer—entry plane of inducer at exit plane of venturi Referring to FIG. 6 there is schematically illustrated internal configuration of the air inductor device of FIG. 2, for test case 2. FIG. 6 shows the position of the secondary inducer relative to the outlet of the large venturi element.

Figure 7:
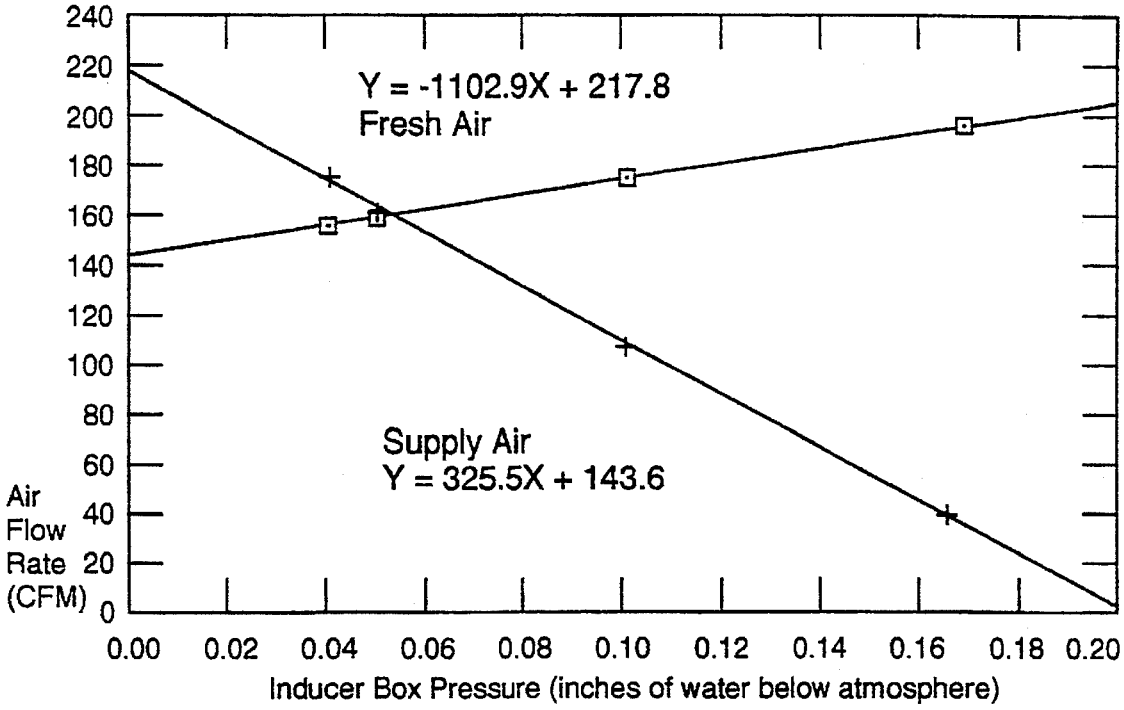
FIG. 7 graphically illustrates the test flow rates for the configuration of FIG. 6.

Referring to FIG. 7 there is graphically illustrated the test flow rates for the configuration of FIG. 6. FIG. 7 shows the experimental results obtained with these two elements. Comparison of FIGS. 4 and 7 indicates the there was very little change in flows as a result of the installation of the secondary inducer.

At relatively large flow restriction (inducer box pressure less than −0.12 inches $H_2O$) the secondary inducer does result in lower fresh air flow. While the results show that flows did not change significantly, no tests were performed to evaluate mixing enhancement. The secondary inducer element may play a part in reducing temperature variations in the mixed air stream that is delivered back to the return plenum of the heating system but that effect would have to be evaluated using other techniques.

Figure 8:
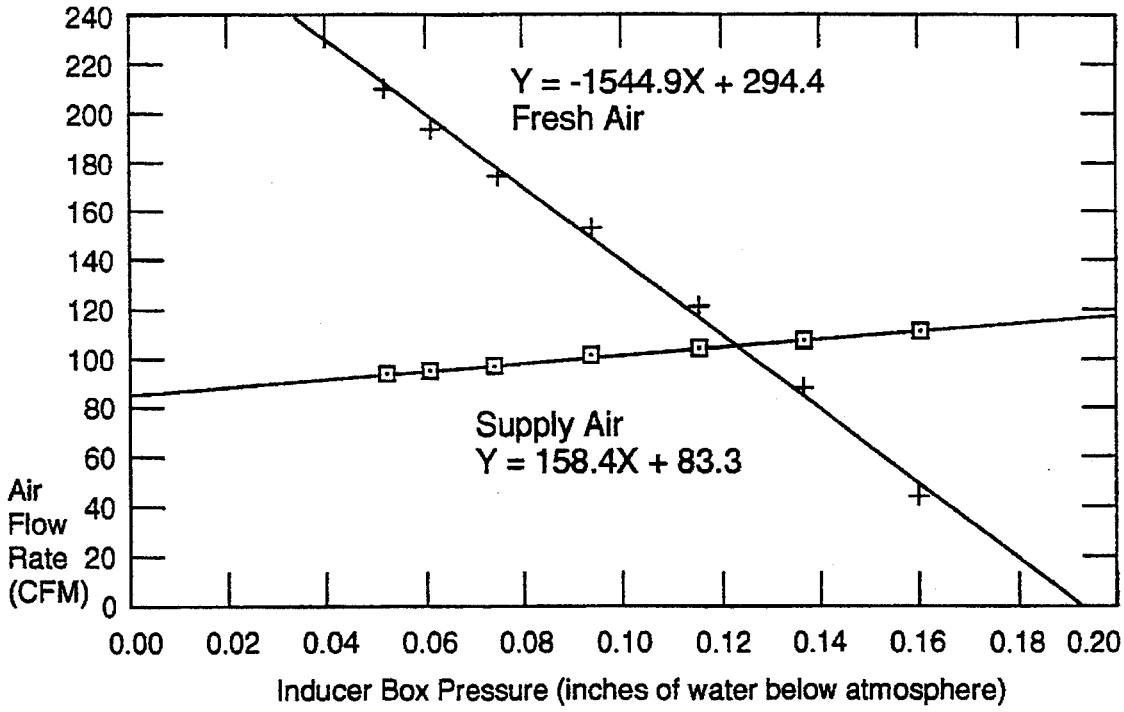
FIG. 8 graphically illustrates the test flow rates for the configuration of FIG. 6, with a small venturi tube.

CASE 3 Small 3 inch venturi—6 inches from end of venturi to inlet of return duct, no secondary inducer Referring to FIG. 8 there is graphically illustrated the test flow rates for the configuration of FIG. 6, with a small venturi tube;

The experimental results obtained with the small (3 in) venturi installed the inducer box with no secondary elements is shown in FIG. 8. The small venturi produces higher velocities at its exit than the larger venturi and consequently the pressures that initiate the induction of fresh air are stronger.

As a result the small venturi has greater flow rates of fresh air (especially at lower flow restrictions) than the large venturi. The amount of supply air required to induce this fresh air is much less (typically 60% less) than the large venturi configuration.

Recalculating the flow rate expected from 15 feet of 8 inch ducting, two elbows, screen and entry losses gives the inducer box pressure at −0.08 in $H_2O$ and a flow rate of 170 cfm. This is a 21% larger flow rate than the large venturi configuration and could be used in houses 21% larger then those stated for the larger venturi.

Figure 10:
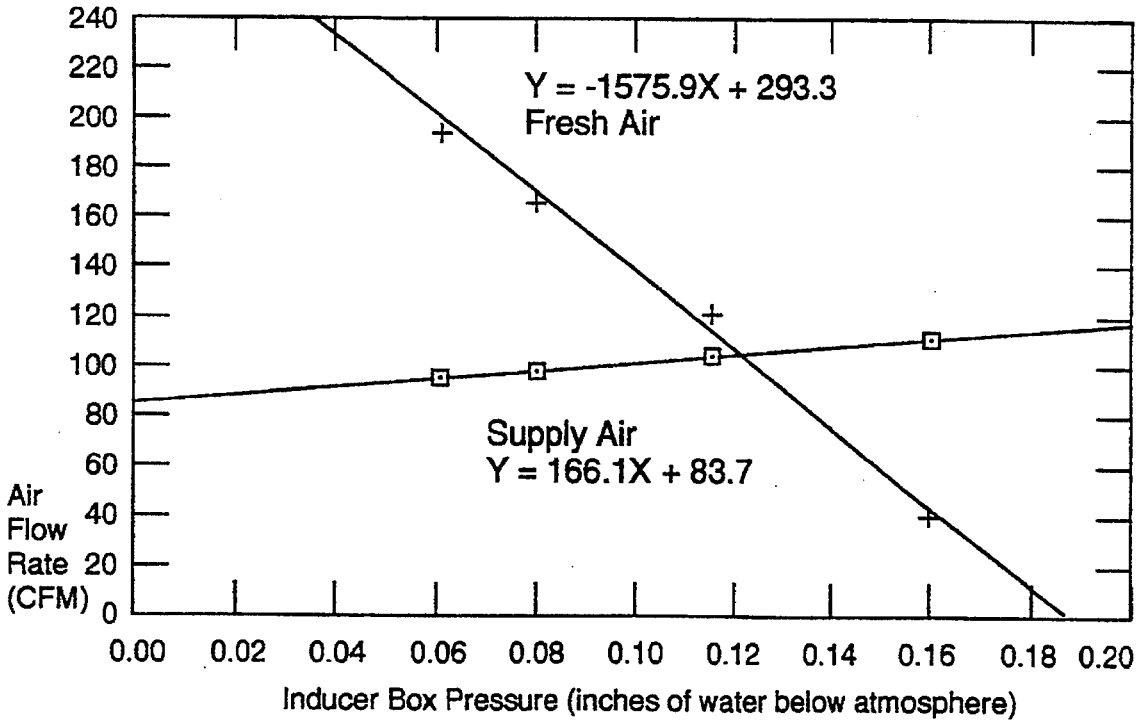
FIG. 10 graphically illustrates the test flow rates for the configuration of FIG. 9.

CASE 4 Small 3 inch venturi—6 inches from end of venturi to inlet of return duct Large Secondary Inducer—entry plane of inducer at exit plane of venturi, shown in FIG. 10

Figure 9:
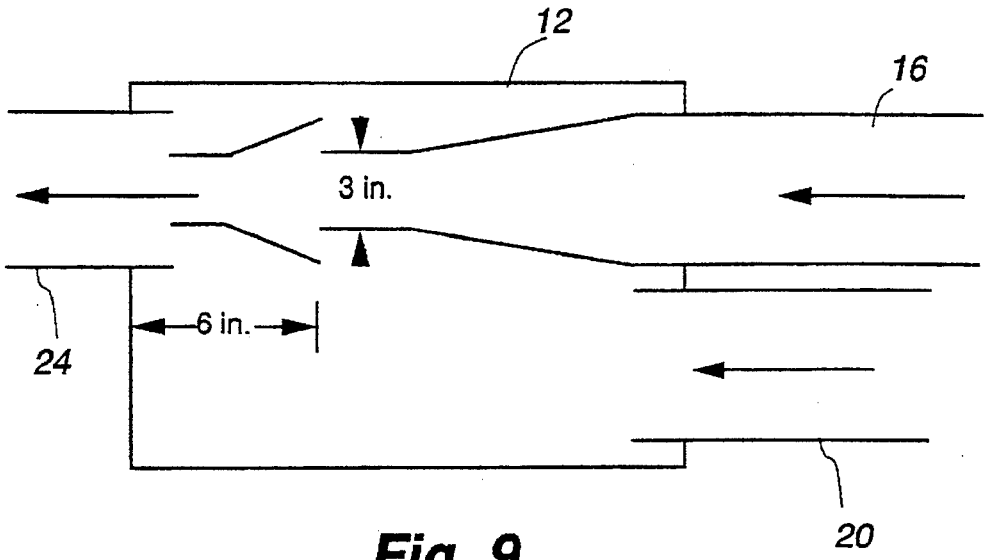
FIG. 9 schematically illustrates internal configuration of the air inductor device of FIG. 2, for test case 4.

Referring to FIG. 9 there is schematically illustrated internal configuration of the air inductor device of FIG. 2, for test case 4.

Referring to FIG. 10 there is graphically illustrated the test flow rates for the configuration of FIG. 9. FIG. 10 shows that the larger secondary inducer placed with the inlet at the outlet of the venturi has no measurable effect on the flow rates of either the fresh or supply air. This result can be seen most easily by visually comparing FIGS. 8 and 10. As was stated previously the degree to which mixing would be altered as a result of the secondary inducer element was not evaluated.

Figure 12:
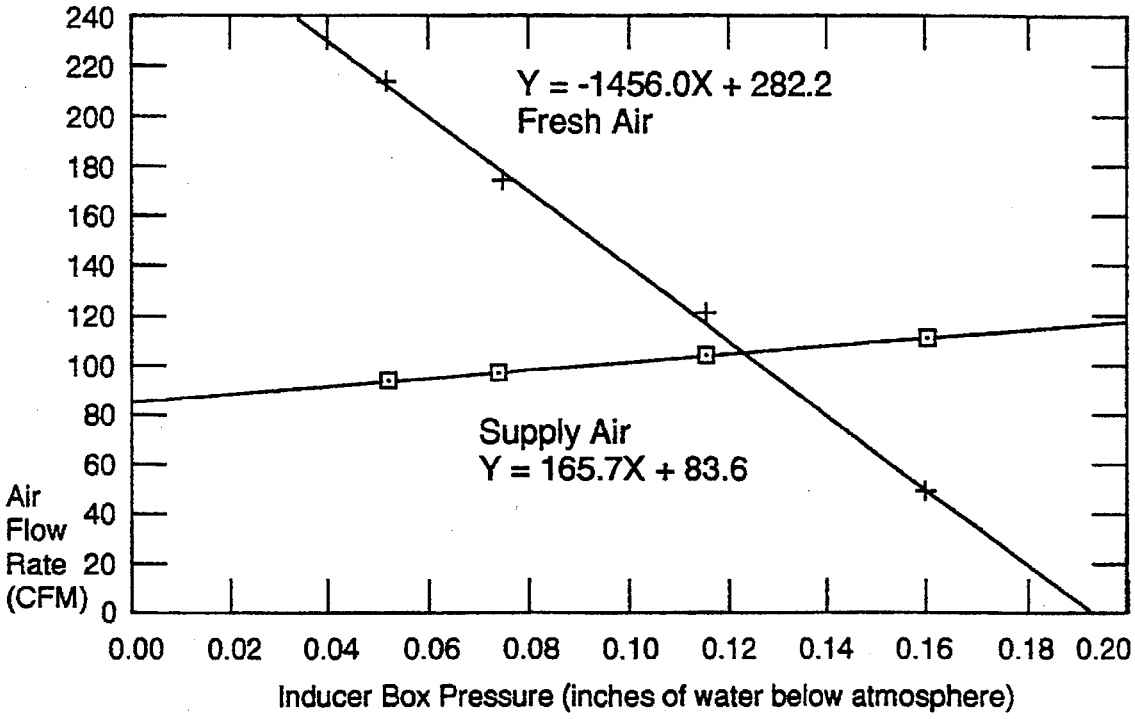
FIG. 12 graphically illustrates the test flow rates for the configuration of FIG. 11.

CASE 5 Small 3 inch venturi—6 inches from end of venturi to inlet of return duct, Large Secondary Inducer—entry plane of inducer centrally positioned between exit plane of venturi and inlet to return duct, shown in FIG. 12.

Figure 11:
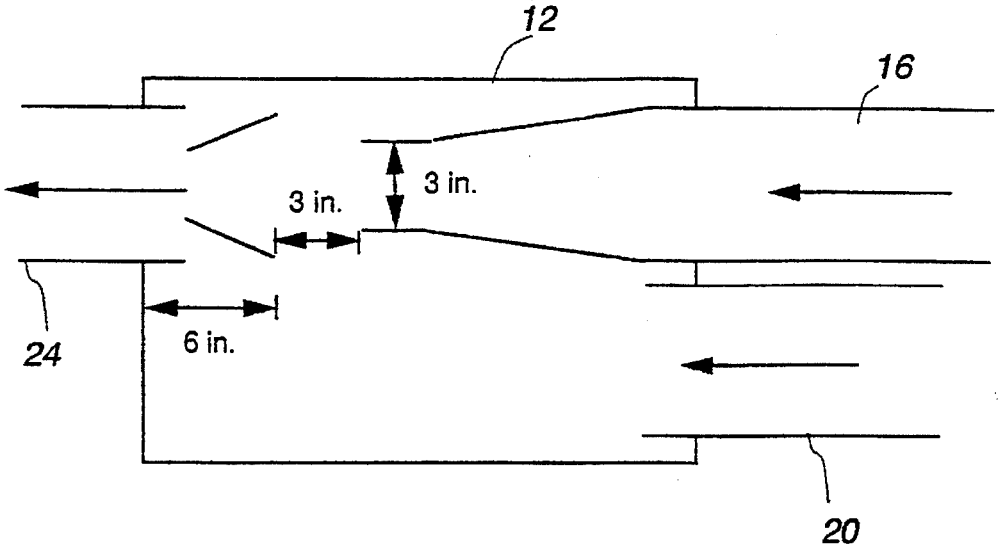
FIG. 11 schematically illustrates internal configuration of the air inductor device of FIG. 2, for test case 5.

Referring to FIG. 11 there is schematically illustrated internal configuration of the air inductor device of FIG. 2, for test case 5.

Referring to FIG. 12 there is graphically illustrated the test flow rates for the configuration of FIG. 11.

Comparison of FIGS. 8, 10 and 12 (no secondary inducer, secondary inducer in two positions) shows that different positions of the secondary inducer cone have virtually no effect of the flow rates of either fresh or supply air. An exception to this was found when the secondary inducer was placed fully inside the return duct in which case the fresh air flow rate dropped significantly.

CASE 6 Small 3 inch venturi—6 inches from end of venturi to inlet of return duct Secondary Inducers—entry plane of large inducer at exit plane of venturi and small inducer centrally positioned between exit plane of venturi and inlet to return duct.

Figure 13:
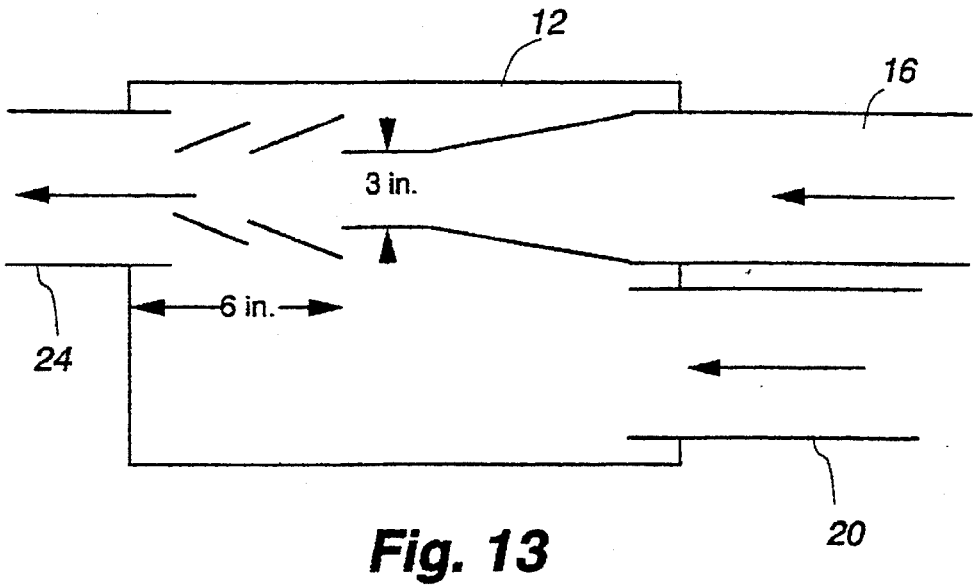
FIG. 13 schematically illustrates internal configuration of the air inductor device of FIG. 2, for test case 6.

Referring to FIG. 13 there is schematically illustrated internal configuration of the air inductor device of FIG. 2, for test case 6. FIG. 13 shows the placement of the secondary inducer elements relative to the outlet of the small venturi and the inducer box outlet.

Figure 14:
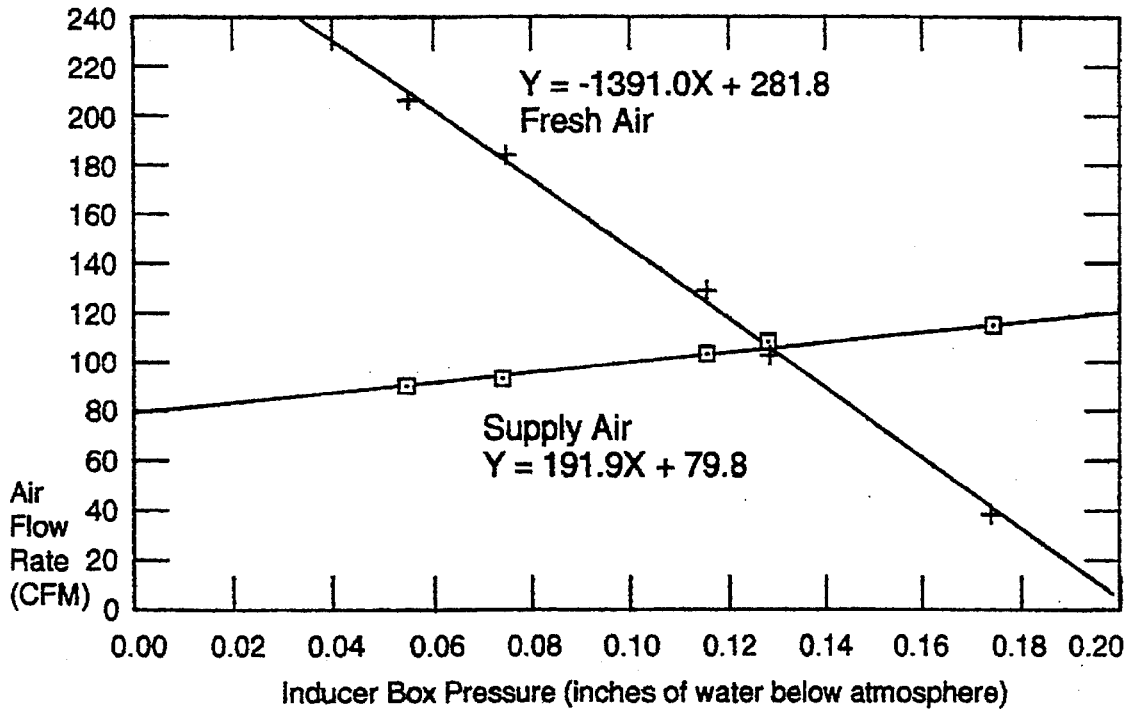
FIG. 14 graphically illustrates the test flow rates for the configuration of FIG. 13.

Referring to FIG. 14 there is graphically illustrated the test flow rates for the configuration of FIG. 13. FIG. 14 shows that having the two secondary inducer cones installed has little effect on the flow rates of either fresh or supply air when the drop in the inducer box is low. At higher inducer box pressure (higher restriction in the fresh air ducting) the flow rate of fresh air was observed to increase by approximately 20%, from 50 cfm to 60 cfm at a pressure of −0.16 in $H_2O$. No explanation for this observation is offered but it should be kept in mind that the uncertainties in flow measurement increase at very low flow rates.

Measured Performance—Heated Flows

To evaluate the performance of the inducer box under conditions when the furnace was operating two cases were chosen, large and small venturi with no inducers. The two case were chosen as a result of previous tests which showed that the secondary elements had little effect on inducer performance. In each case the venturi was installed, supply pressure, return pressure and damper position set and the unit was allowed to reach thermal equilibrium. Table 1 shows the temperatures obtained in each of the test cases. The mixed air temperature is a function of the supply air temperature, return temperature and the corresponding volume flow rates.

TABLE 1

Measured Air Temperatures with the Inducer Air Supply Heated

| | Supply Air Flow (CFM) | Fresh Air Flow (CFM) | Supply Temperature °C. (°F.) | Fresh Air and Return Temperature °C. (°F.) | Mixed Air Temperature °C. (°F.) |
|---|---|---|---|---|---|
| 4 Inch Venturi | 172 | 183 | 58 (136) | 21 (70) | 37 (99) |
| | 194 | 161 | 60 (140) | 21 (70) | 39 (102) |
| | 198 | 105 | 62 (144) | 21 (70) | 43 (109) |
| | 222 | 37 | 63 (145) | 21 (70) | 51 (124) |
| 3 Inch | 100 | 213 | 47 (117) | 21 (70) | 27 (81) |
| | 104 | 180 | 48 (118) | 21 (70) | 28 (82) |
| | 111 | 125 | 49 (120) | 21 (70) | 31 (88) |
| | 120 | 36 | 51 (124) | 21 (70) | 38 (100) |

Figure 15:
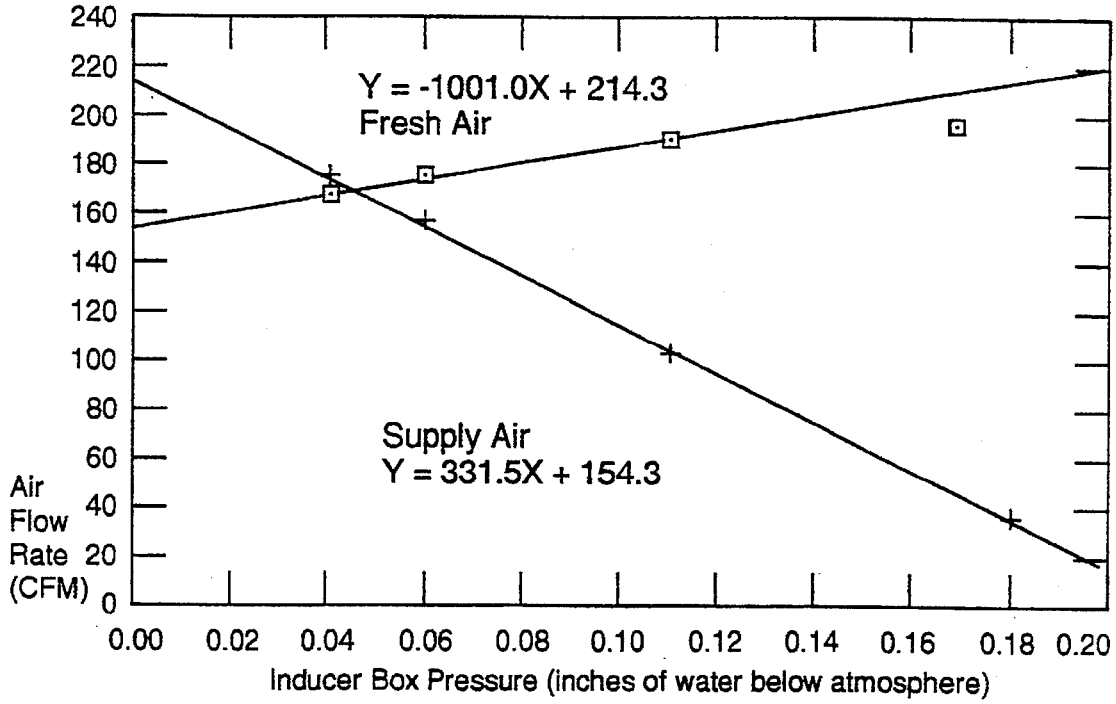
FIG. 15 graphically illustrates the test flow rates for the configuration of FIG. 3, with heated air.

Referring to FIG. 15 there is graphically illustrated the test flow rates for the configuration of FIG. 3, with heated air. In the first case evaluated, the 4 inch venturi, the result was as expected. Comparisons of FIGS. 4 and 15, supply air unheated and heated, shows that the flow rate of heated air volume flow rate must be increased to achieve the same inlet pressure, +0.16 in $H_2O$, because of the reduced supply air density. At first glance one would think that since the air flow rate is increased a larger pressure drop should occur through the venturi but as indicated in the equations that follow the reduced density compensates for the increased air flow and the pressure drop that occurs through the venturi remains constant.

$$\Delta P = \frac{1}{2}\ \frac{C\rho Q^2}{A^2}$$

In this equation ΔP is the pressure drop across the duct work, C is a coefficient that depends on the geometry of the duct work, ρ is the air density, Q is the volumetric flow rate and A is the duct area.

Since air at typical temperatures and pressures found in system behaves as an ideal gas, the density will be inversely proportional to the absolute temperature as indicated.

$$\rho \alpha \frac{1}{T}$$

As the flow enters the venturi and accelerates there is a reduction in pressure which can be calculated using the Bernoulli equation shown below.

$$P_2 = P_1 + \rho\left[\frac{V_1^2 - V_2^2}{2}\right]$$

In this equation, $V_1$, and $V^2$ are the air velocities at the inlet and reduced area of the venturi respectively. $P_1$ is the pressure at the inlet to the venturi and $P^2$ is the reduced pressure at the exit of the venturi. Although the flow has been accelerated by a greater amount due to the increased volume flow rate the density reduction compensates. It is important to note that the flow rate of fresh air was not affected by the supply air being heated. As long as the box pressure is the same the flow of fresh air remains constant.

Figure 16:
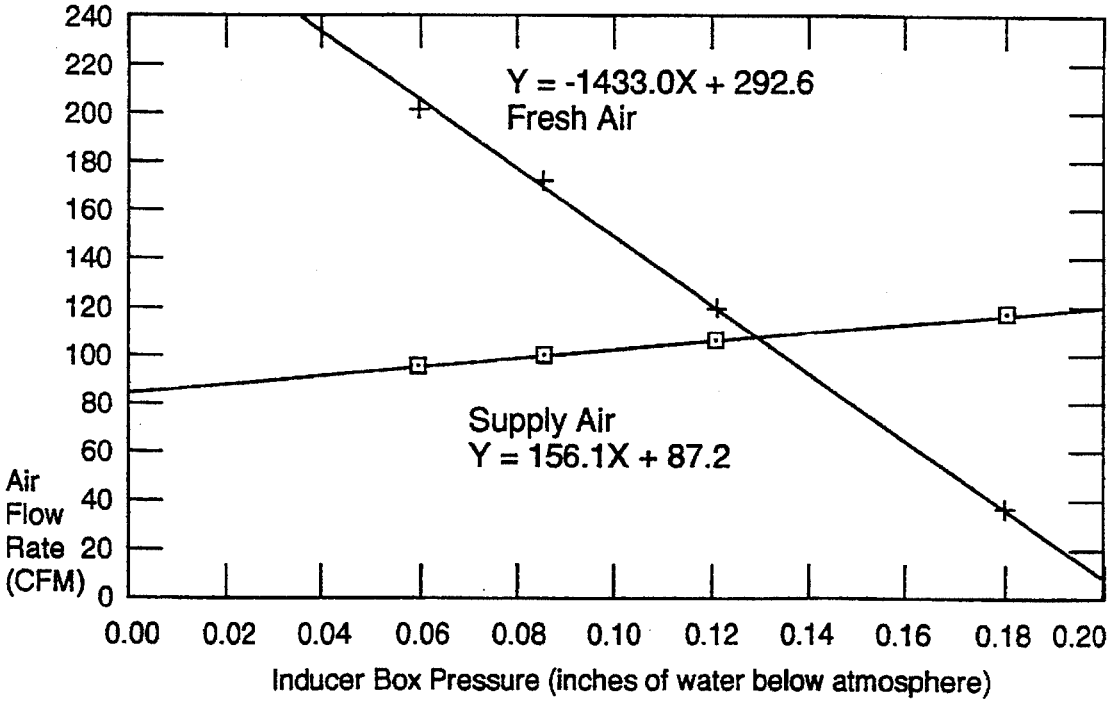
FIG. 16 graphically illustrates the test flow rates for the configuration of FIG. 6, with heated air.

Referring to FIG. 16 there is graphically illustrated the test flow rates for the configuration of FIG. 6, with heated air. In the second case, 3 inch venturi, the supply air flow rates were again increased in order to maintain the same +0.16 in $H_2O$ pressure at the inlet to the venturi. At low fresh air duct resistance (high fresh air flow rates) the results with heated and unheated flows were virtually identical. When the damper on the fresh air duct was moved towards the closed position (low fresh air flow rates) the results were slightly different. The flow rate of fresh air appeared to be slightly higher when heated air was used. As there does not appear to be a physical basis for the result, it is likely that experimental errors, rather than a physical cause, led to the result. Again the flow rate of fresh air is not affected by the change in supply air temperature.

Predicted Performance

The full operating range for the fresh air inducer box could not be measured and therefore its performance under some conditions needs to be calculated. The primary concern on performance are when the ambient outdoor air drops to very cold temperatures. The design conditions considered are when the outdoor temperature drops to −40° C. As this temperature drops the fresh air flow rate will change, as will the temperatures of the various flow throughout the ducts. The principles applied to allow the flows and temperatures to be estimated are the conservation of mass and energy, and Bernoulli's equation.

The conservation of mass in a steady state, steady flow process like the inducer box when written as a rate is $$M_f + M_s = M_s$$

where M is the mass flow rate, and subscripts f, s and m are for the fresh air, supply air and the mixed air, respectively. Written as flow rates this becomes $$P_f Q_f + P_s Q_s = P_m Q_m$$

Conservation of energy, when applied to the streams flowing into and out of the fresh air inducer box when heat transfer from the box is neglected is $$E_f + E_s = E_m$$

where E is the rate energy is carried in the streams, and can also be written as $$T_f C_f \rho_f Q_f + T_s C_s \rho_s Q_s = T_m Cm P_m Q_m$$

where T is temperature and C is the specific heat capacity at constant pressure. If the usual assumptions are made that the pressure and specific heats are constant, and that air is behaving like an ideal gas then this equation can be simplified to $$Q_f + Q^S = Q_m$$

Combining these equations allows the mixed air temperature to be calculated using or $$T_m = \frac{1}{\frac{X_f}{T_f} + \frac{X_s}{T_s}}$$

$$T_m = \frac{T_f T_s}{T_s X_f + T_f X_s}$$

where X is the volume fraction (e.g., the volume fraction of fresh air is $Q_f/Q_m$).

The change in flow rate through any of the ducts because of different ensity air can be calculated from Bernoulli's equation as presented previously. If one knows the flow rate at one gas density, the flow rate for another density at the same pressure difference is given by $$Q_{new} = Q_{old}\sqrt{\frac{\rho_{old}}{\rho_{new}}}$$

Treating air as an ideal gas allows this expression to be written in terms of temperatures $$Q_{new} = Q_{old}\sqrt{\frac{T_{new}}{T_{old}}}$$

where the temperatures must be absolute (i.e., Kelvin).

Before presenting the predicted performance a sample calculation is considered to illustrate how to convert any of the measured results to conditions other than those tested. The starting point for all these calculations is the measure performance of the inducer box when the burners were not on. Consider the case of the small 3 inch venturi and no secondary inducer. The flow rates of fresh and supply air going through the inducer box when the outside air is at −40° C., and return and supply air temperatures are required when a 80% efficient 120,000 BTUH furnace with at 1200 cfm flow rate is used. Expressions for the fresh and supply flow rates through the inducer box at the measured conditions (21° C., 1 atm) are (FIG. 9)

$$Q_f = -1544.9\ P_b + 294.4$$

$$Q_s = 158.4\ P_b + 83.3$$

To begin the calculation the pressure drop across the fresh air intake system ($P_b$) and the supply air temperature must be guessed. For this example, let $P_b$=0.04 inches of water and $T_s$=55° C., these assumptions must be checked later to see if they are correct. The flow rates of fresh and supply air at −40° C. and 55° C., respectively are $$Q_f = -1228.2\ P_b + 234$$

$$Q_s = 166.7\ P_b + 87.7$$

at $P_b$=0.04, $Q_f$=185.6 cfm, $Q_s$=94.4 cfm, and the sum of these two is $Q_m$=280 cfm. The volume fraction of the fresh and supply air $X_f$=0.663 and $X_s$=0.337, respectively, which gives a mixed air temperature of 258K or −15° C. Given this temperature it would appear necessary to insulate the inducer box and the connecting ducts to prevent condensation.

The return conditions to the furnace are then calculated by letting this 280 cfm mix with the air returning from the house at a flow rate of 1200−280=920 cfm at, for example, 18° C.

The return air temperature can be calculated using the equation shown below.

$$T_r = \frac{T_m T_{hr}}{T_m X_{hr} + T_{hr} X_m}$$

Where the subscripts r, m and hr refer to the return air to the furnace, the mixed air leaving the inducer box and the return from the house, respectively. In this case the return temperature entering the furnace will be 10° C. To calculate the supply temperature, 80% of the 120,000 Btu/h is added to that flow resulting in a supply temperature of 52° C. This compares well to the guess of 55° C. and there is no need to iterate.

TABLE 2

Predicted flow rates and temperatures when $P_b$ = 0.04 inches Water, 120,000 Btu/h furnace, 80% efficient, 1200 cfm fan, and room temperature of 18° C.

| | $Q_r$ @ −40° C., | Burner Off | | Burner On | |
|---|---|---|---|---|---|
| Venturi | 1 atm | $T_{return}$ | $T_{supply}$ | $T_{return}$ | $T_{supply}$ |
| 4 inch | 138 cfm | 9° C. | 9° C. | 12° C. | 54° C. |
| 3 inch | 185 cfm | 7° C. | 7° C. | 10° C. | 52° C. |

TABLE 3

Predicted flow rates and temperatures when $P_b$ = 0.18 inches Water, 120,000 Btu/h furnace, 80% efficient, 1200 cfm fan, and room temperature of 18° C.

| | $Q_r$ @ −40° C., | Burner Off | | Burner On | |
|---|---|---|---|---|---|
| Venturi | 1 atm | $T_{return}$ | $T_{supply}$ | $T_{return}$ | $T_{supply}$ |
| 4 inch | 28 cfm | 17° C. | 17° C. | 24° C. | 66° C. |
| 3 inch | 13 cfm | 17° C. | 17° C. | 21° C. | 63° C. |

A final consideration is one that is likely to occur given the propensity of the home owner to perceive that dollars are being wasted through the heating of fresh air. This case involves blocking of the fresh air inlet to the inducer unit. Normally with a fresh air duct connected between outdoors and the return side of the furnace this will not result in a problem as the system was initially designed for a return air temperature of approximately room temperature. In the case of the flow inducer box a significant portion of the supply air is recirculated through the inducer unit to the return of the furnace. With no outside air added the return temperature will climb until a thermal equilibrium is reached between the losses from the duct work and the energy added by the furnace. Since it is likely that the duct work will be insulated to prevent condensation during winter periods the equilibrium point can result in higher than normal return temperatures as shown in Table 4. The results shown are based on a flow rate of 1200 cfm through the furnace, a return temperature from the house of 18° C. and that the unit is 120,000 Btu/h at an efficiency of 80%.

TABLE 4

System Temperatures with Inducer System Installed and Fresh Air Intake Blocked

| | Supply Temperature (°C.) | Return Temperature (°C.) |
|---|---|---|
| 3 Inch Venturi | 64 | 22 |
| 4 Inch Venturi | 69 | 27 |

Conclusions

A fresh air inducer intended as a means of providing fresh air in housing was tested in the laboratory under a variety of conditions to determine the effects of venturi size and additional mixing elements on the units ability to induce a flow of fresh air. The unit was tested with both room temperature and heated air flowing through the venturi as well as a series of flow restrictions on the fresh air duct. The restrictions on the fresh air duct were used to determine the effects of different installations (duct length, elbows, inlet screen mesh, etc.) on the performance of the unit. Based on the laboratory testing the following conclusions were drawn.

1. The fresh air induced by this unit under laboratory conditions (not an in-house environment) showed promising results. For a typical fresh air duct system, flows of 140–170 cfm were induced into the return plenum.
2. The use of a 3 inch venturi rather than the 4 inch venturi results in larger induced air flow rates at lower supply air flow rates due to the lower internal pressure produced by the venturi at a given air flow rate through the unit. This means that smaller quantities of air must be bypassed through the unit to induce a given quantity of fresh air. As a result, the mixed air temperature returning to the furnace will be higher with the small venturi than with the larger unit.
3. The use of secondary diffuser elements to mix the supply and fresh air streams was not found to impair the ability of the unit to induce a flow of fresh air. The degree to which the supply and fresh air streams were mixed as a result of the secondary elements was not evaluated.

Numerous modifications, variations, and adaptions may be made to the particular embodiments of the invention described above without departing from the scope of the invention, which is defined in the claims.

What is claimed is:

1. An air inductor device comprising:

a chamber having first and second inlets and an outlet, the first inlet and the outlet being substantially aligned along a first axis;

a venturi tube inside the chamber coupled to the first inlet having a reduced diameter exit;

a secondary inducer substantially aligned with the first axis and disposed between the exit of the venturi tube and the outlet, the secondary inducer including a plurality of funnels having decreasing diameter inlets and arranged from largest diameter inlet to smallest diameter inlet between the exit of the venturi tube and the outlet;

the first inlet for connecting a first duct from a supply plenum of a forced air heating appliance to the chamber, the second inlet for connecting a supply of outside air to the chamber, the outlet for connecting the chamber to a return plenum of the forced air heating appliance whereby air from the supply plenum mixes with outside air within the chamber to provide tempered air to the return plenum.

2. A device as claimed in claim 1 wherein the secondary inducer includes a funnel having a large opening and a small opening, the large opening facing the exit of the venturi tube.

3. A device as claimed in claim 2 wherein the large opening of the funnel and the exit of the venturi are substantially aligned in a plane transverse to the first axis.

4. A device as claimed in claim 2 wherein the large opening of the funnel lies midway between the outlet and the exit of the venturi tube.

5. A device as claimed in claim 1 wherein the plurality of funnels includes a first funnel and a second funnel, the first funnel being larger than the second funnel and disposed adjacent the exit of the venturi tube, the second funnel disposed between the first funnel and the outlet.

6. In an air heating system having a forced air heating appliance, a supply plenum for carrying heated air, a return plenum for carrying cooled air and a fan between the return plenum and the supply plenum an air inductor device comprising:

a chamber having first and second inlets and an outlet, the first inlet and the outlet being substantially aligned along a first axis; and a venturi tube inside the chamber coupled to the first inlet having a reduced diameter exit;

the first inlet for connecting a first duct from the supply plenum of the forced air heating appliance to the chamber, the second inlet for connecting a supply of outside air to the chamber, the outlet for connecting the chamber to the return plenum of the forced air heating appliance whereby air from the supply plenum mixes with outside air within the chamber to provide tempered air to the return plenum.

7. A device as claimed in claim 6 further comprising a secondary inducer substantially aligned with the first axis and disposed between the exit of the venturi tube and the outlet.

8. A device as claimed in claim 7 wherein the secondary inducer includes a funnel having a large opening and a small opening, the large opening facing the exit of the venturi tube.

9. A device as claimed in claim 8 wherein the large opening of the funnel and the exit of the venturi tube are substantially aligned in a plane transverse to the first axis.

10. A device as claimed in claim 8 wherein the large opening of the funnel lies midway between the outlet and the exit of the venturi tube.

11. A device as claimed in claim 7 wherein the secondary inducer includes a plurality of funnels having decreasing diameter inlets and arranged from largest diameter inlet to smallest diameter inlet between the exit of the venturi tube and the outlet.

12. A device as claimed in claim 11 wherein the plurality of funnels includes a first funnel and a second funnel the first funnel being larger than the second funnel and disposed adjacent the exit of the venturi tube, the second funnel disposed between the first funnel and the outlet.

13. An air heating system comprising:

a forced air heating appliance having a fan for drawing air from a plenum inlet through a heat exchanger and out a plenum outlet;

a supply plenum connected to the plenum outlet for supplying air from the heating appliance to a building;

a return plenum connected to the plenum inlet for returning air from the building to the heating appliance;

an outside air duct for supplying air from outside the building; and an air inductor device comprising:

a chamber having first and second inlets and an outlet, the first inlet and the outlet being substantially aligned along a first axis; and a venturi tube inside the chamber coupled to the first inlet having a reduced diameter exit;

a first duct connecting from the supply plenum of the forced air heating appliance to the first inlet of the chamber;

a second duct connecting the outside air duct to the second inlet of the chamber;

a third duct connecting the outlet of the chamber to the return plenum of the forced air heating appliance whereby air from the supply plenum mixes with outside air within the chamber to provide tempered air to the return plenum.

14. A device as claimed in claim 13 further comprising a secondary inducer substantially aligned with the first axis and disposed between the exit of the venturi tube and the outlet.

15. A device as claimed in claim 14 wherein the secondary inducer includes a funnel having a large opening and a small opening, the large opening facing the exit of the venturi tube.

16. A device as claimed in claim 15 wherein the large opening of the funnel and the exit of the venturi tube are substantially aligned in a plane transverse to the first axis.

17. A device as claimed in claim 15 wherein the large opening of the funnel lies midway between the outlet and the exit of the venturi tube.

18. A device as claimed in claim 14 wherein the secondary inducer includes a plurality of funnels having decreasing diameter inlets and arranged from largest diameter inlet to smallest diameter inlet between the exit of the venturi tube and the outlet.

19. A device as claimed in claim 18 wherein the plurality of funnels includes a first funnel and a second funnel the first funnel being larger than the second funnel and disposed adjacent the exit of the venturi tube, the second funnel disposed between the first funnel and the outlet.

* * * * *

UNITED STATES PATENT AND TRADEMARK OFFICE

CERTIFICATE OF CORRECTION

PATENT NO. : 5,636,993

DATED : June 10, 1997

INVENTOR(S) : Vernon C. Badry

It is certified that error appears in the above-indentified patent and that said Letters Patent is hereby corrected as shown below:

Claim 3, Col. 13, line 61, after "venturi" insert --tube--

Claim 6, Col. 14, line 7, after "plenum" (second occurrence) insert -- , --

Signed and Sealed this

Nineteenth Day of May, 1998

*Attest:*

*Attesting Officer*

BRUCE LEHMAN

*Commissioner of Patents and Trademarks*